US005365840A

United States Patent [19]

Newman

[11] Patent Number: 5,365,840

[45] Date of Patent: Nov. 22, 1994

[54] SCREEN MATERIAL FOR AND METHOD OF SCREEN PRINTING

[76] Inventor: Donald E. Newman, 419 Rices Mill Rd., Wyncote, Pa. 19095

[21] Appl. No.: 39,064

[22] PCT Filed: Oct. 2, 1991

[86] PCT No.: PCT/US91/07163

§ 371 Date: Apr. 2, 1993

§ 102(e) Date: Apr. 2, 1993

[51] Int. Cl.[5] ..... B05C 17/06

[52] U.S. Cl. ..... 101/127.1; 101/127

[58] Field of Search ..... 101/127.1, 127, 128.4, 101/129, 121, 122, 125, 126; 38/102.1; 428/255, 256, 209

[56] References Cited

U.S. PATENT DOCUMENTS

| | | | |
|---|---|---|---|
| 2,015,087 | 11/1932 | Rafton | 209/403 |
| 3,632,382 | 1/1972 | Reed | 101/126 X |
| 3,741,116 | 6/1973 | Green et al. | 101/287 |
| 3,900,641 | 8/1975 | Woodman et al. | 428/38 |
| 3,908,293 | 9/1975 | Newman | 38/102.91 |
| 4,096,308 | 6/1978 | Reed | 428/247 |
| 4,129,076 | 12/1978 | Gardner | 101/127 |
| 4,242,401 | 12/1980 | Mitani | 428/201 |
| 4,345,390 | 8/1982 | Newman | 38/102.91 |
| 4,376,815 | 3/1983 | Oddi | 430/313 |
| 4,525,909 | 7/1985 | Newman | 492/24 |
| 4,649,817 | 3/1987 | Smith | 101/129 |
| 4,778,546 | 10/1988 | Kitani | 156/73.3 |
| 4,824,717 | 4/1989 | Nakanishi | 428/255 |
| 4,843,961 | 7/1989 | Smith | 101/127.1 |
| 4,959,260 | 9/1990 | Tomoyasu | 428/255 |
| 5,127,176 | 7/1992 | Newman | 38/102.1 |

FOREIGN PATENT DOCUMENTS 2128586 5/1984 United Kingdom .

OTHER PUBLICATIONS

Reimer, *International Journal For Hybrid Microelectronics,* vol. 10, No. 2, 1987, pp. 1–8.

Product Information, Page from catalog from Pecap–M Metallized Polyester Monofilm and Fabrics (date unknown).

Product Information, Page from catalog from Appiano Gentile–(Como) Italia, dated Mar. 28, 1977.

Product Information, Page from catalog for "Metalester", from Appiano Gentile–(Como) Italia.

Screen Priting Association International's *Technical Guide Book of the Screen Printing Industry,* Jan. 1974.

Product Information, Page from catalog from Pecap–M for monofilament polyester (date unknown).

Product Information, Page from Saatilene Monofilament Polyester, "Suggested Max[ium] Frabric Tension in Newtons/cm" (date unknown).

*Primary Examiner*—Edgar S. Burr

*Assistant Examiner*—Eric P. Raciti

*Attorney, Agent, or Firm*—Seidel, Gonda, Lavorgna & Monaco

[57] ABSTRACT

The present invention relates to screen printing operation, and particularly a screen printing operation at a relatively high tension. The nominal thread diameter of the screen material as woven is contemplated to be essentially increased over that generally found in the prior art while substantially maintaining the standard mesh count arrangements as woven. The combination of high tension and increased thread diameter while maintaining the thread count results in a substantial improvement to the printed product and printing operation.

9 Claims, 3 Drawing Sheets

SCREEN MATERIAL FOR AND METHOD OF SCREEN PRINTING

FIELD OF THE INVENTION

The present invention relates to screen printing utilizing a printing frame having a tensioned fabric thereon. Generally, the present invention contemplates the tensioning of the fabric or screen material with a roller type frame. The improved screen material permits higher tensions to be achieved so that various improvements are accomplished in the printing process. Moreover, the present invention relates to a method of using higher screen tensions and to the improved screen material so as to obtain these advantages.

BACKGROUND OF THE INVENTION

In the process of screen printing, the result achieved by the printing equipment is no better than the screen material utilized therewith. Even if a frame is stable and does not change during operation, inaccurate results can be achieved if the fabric screen material fails or stretches during the printing process.

New low elongation fabrics have been developed in recent years. However, even these fabrics begin to relax soon after the squeegee is first applied to transfer ink during the printing process. This is analogous to the tuning of a guitar with new guitar strings. The process is thus complicated by this initial relaxation during use. Loss in screen tension during any part of the printing process can result in image distortion, mis-registration, blurred edges, color shifts, ink penetration through porous or semi-porous substrates (such as uncoated paper or cloth garments), and ink build-up on the bottom of the screens. Manifestly, these changes in tension will require ink, squeegee and press adjustments during the printing operation. The result of this change in tension is a loss in quality, productivity and control over the printing process.

Roller type frames, such as those manufactured by Stretch Devices, Inc. of Philadelphia, Pa., may be utilized to meet the rigidity and stability requirements for accurate screen printing results. These roller type frames permit the retensioning of the fabric so as to maintain a constant tension over the entire printing operation. In a roller type frame, retensioning is performed by rotating (at least) one roller within the frame. This retensioning is performed after the fabric has received the stress exerted by the squeegee and has reacted to all of the inks and chemicals in the processes. This retensioning tends to restress or shock the polymer chains in the screen fibers and is essentially a work-hardening type process. During retensioning, the molecular chains become more and more highly oriented in the direction of the fibers while developing even greater bond strength. The more the screen is used and retensioned (restressed) after reclaiming, the stronger and more stable it becomes. Manifestly, screens that have been worked for an extended period of time will have consistency and repeatability in their printing.

Higher tensions in a screen can result in a faster squeegee speed during the printing operation. The squeegee speed is typically dictated by the speed at which the screen lifts off the substrate. In the lifting of the substrate, a "snap"-action or force is desired to assist in ink shear. Ink shear is important in order to provide accurate lines during the printing process. High tension gives a quicker and/or more forceful snap of the screen off of the substrate and thus a higher ink shear. This results in the ability to use a faster squeegee speed during printing, and thus a faster printing process.

Higher tensions also result in a more uniform application of the ink on the screen by the flood bar prior to the squeegee moving across the screen. Because of the higher tension, there is no build-up at the center of the screen material due to a downward bowing caused by the weight of the ink on the screen material. Moreover, because of the tension in the screen, the flood bar can move more quickly and at a greater force without resulting in the ink being pushed through to the opposite side of the screen material.

In the operating machinery, the off contact distance between the screen and the substrate can be lowered by using higher tension. The lower the off contact distance, the less force required in order to make contact between the screen and the substrate and the less stretching of the image. Off contact distance is also a consideration in determining the snap force by the screen away from the substrate. In higher tensions, the increased snap force is created by the tension in the screen as opposed to the stretching of the screen at a greater off contact distance.

Another advantage obtained by higher tension is permitting the edge of the image on the screen to be closer to the edge of the screen itself. Manifestly, relatively smaller frames may be used and the stroke length of the flood bar and squeegee can be reduced without affecting the resultant image.

Another advantage of the higher tensions in the screen relates to the consistency of thickness of deposit and to color control. These factors are a result of interface pressure between the screen and the substrate upon the application of the ink. With a high interface pressure, there is a significant likelihood of the spread of the ink on the printing substrate. With a higher tension, the amount of force needed to be applied to the substrate is substantially reduced. However, there is little reduction in the force being applied by the squeegee in causing the ink to pass through the screen material to receive a consistent coverage on the substrate.

Other advantages can also be achieved by a high tension printing process. However, these advantages have heretofore not been achieved at the rate possible with the present invention.

BRIEF DESCRIPTION OF THE INVENTION

The present invention particularly relates to a screen type material for use in screen printing having a large diameter thread, as compared to known thread diameters, while maintaining the typical mesh counts of screen materials utilized at lower tensions. In addition, the present invention particularly relates to the tensioning of a screen material with a relatively high or ultra-high tension such as in the range of 40 to 100 newtons per centimeter.

The invention contemplates tensions in the screen material in excess of those either heretofore utilized in the screen printing art and well in excess of those recommended by screen manufacturers for the known screen material. The result of this invention is that the advantages of high tension have been accelerated by the use of these ultra-high tensions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
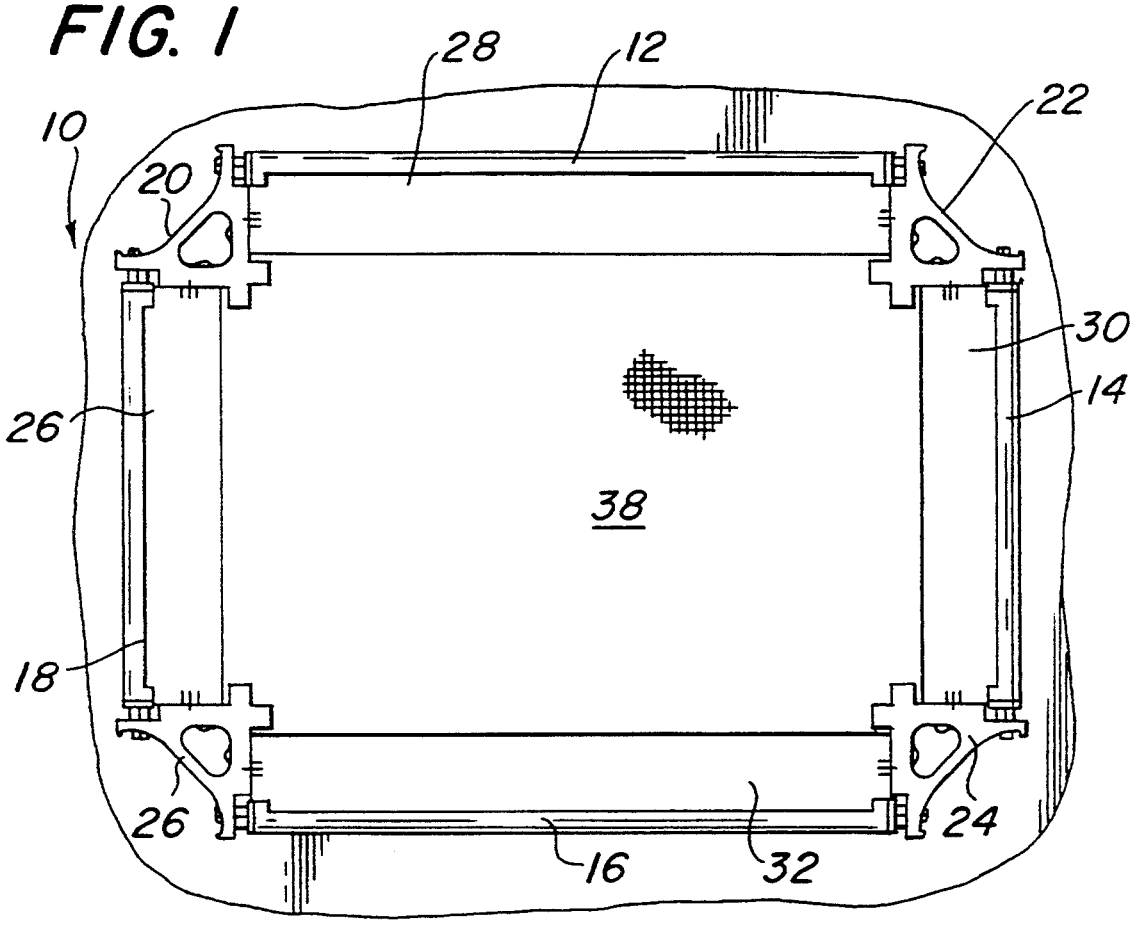
FIG. 1 shows a frame for tensioning a screen or fabric material for use in screen printing.
Figure 6:
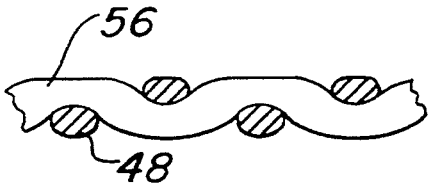
FIG. 6 shows a second cross-sectional view of the screen material shown in FIGS. 4 and 5 as taken along line 6—6 in FIG. 4.

In the drawings where like numerals indicate like elements, there is shown a screen printing frame, identified by the numeral 10. The screen printing frame 10 as illustrated in FIG. 1 includes a series of rollers 12, 14, 16 and 18 which are secured at opposite ends to corner members 20, 22, 24 and 26, respectively. In frame 10, there is further included a series of box or support beams 28, 30, 32 and 36. Secured to each roller 12–18 is a screen material 38. The rollers 12–18 transversely tension the screen 38. The rollers as generally contemplated by the present invention may be made in accordance with U.S. Pat. No. 4,525,909. In addition, the box support beams 28–36 may be made in accordance with U.S. Pat. No. 4,345,390. (The disclosure of these two patents is herein incorporated by reference.) It should be noted, however, that other tensioning members and roller type frames may be utilized as desired.

Figure 2:
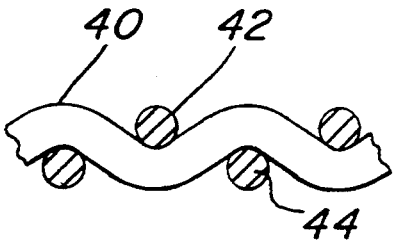
FIG. 2 shows a cross-sectional view of a typical screen material used along with the frame shown in FIG. 1.
Figure 3:
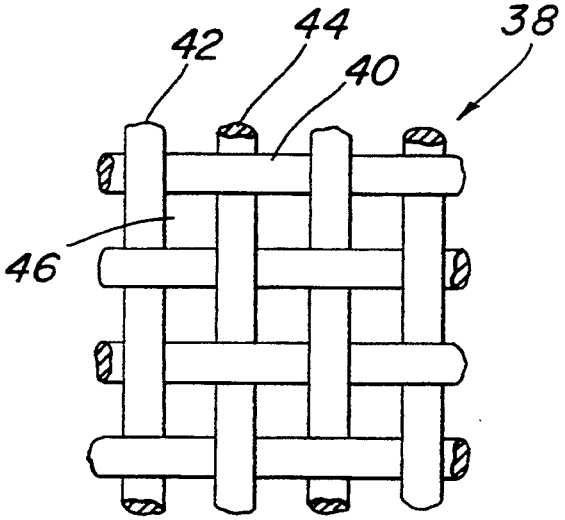
FIG. 3 shows a partial view of the screen material shown in FIG. 2.

In FIGS. 2 and 3, there is shown a typical screen material 38 for use along with the printing frame 10 as shown in FIG. 1. Screen materials for screen printing are generally either a monofilament thread or a multifilament yarn made of a nylon or a polyester material, or the like. These materials are available from a number of sources, such as Tetko Inc. having offices at Briarcliff Manor, N.Y. Steel meshes are also known.

The screen 38, as shown in FIGS. 2 and 3, generally includes various cross hairs or threads 40, 42 and 44 and are woven in a specific pattern. One critical feature of this type screen material 38 is the percent open area between the cross hairs. This open area is designated as element 46 in FIG. 3.

Figure 7:
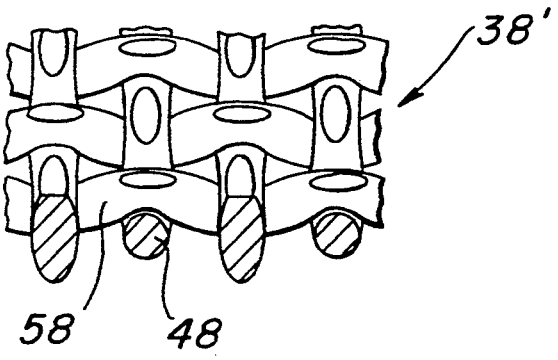
FIG. 7 shows another cross-sectional view of the screen material shown in FIGS. 4–6 taken along lines 7—7 in FIG. 4.
Figure 4:
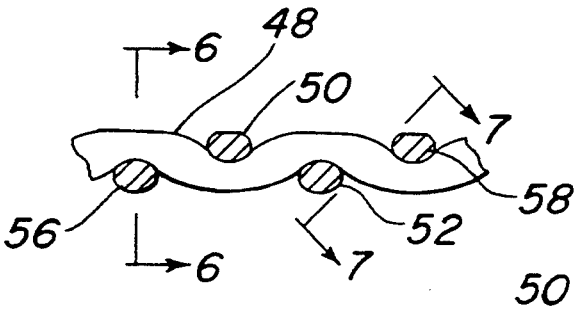
FIG. 4 shows a cross-sectional view of a typical screen material that has been subjected to a calendaring process.

In FIGS. 4–7, there is shown another typical type screen material 38' which has been calendared. A calendaring process generally includes the passage of a screen material such as screen 38 in FIGS. 2 and 3, through two rollers which press or crush the material, specifically the joint or knuckles of the crossing threads. The calendaring process generally includes a heat and pressure operation on one side while applying only pressure to the opposite side. As can be seen in FIG. 4, the lateral threads 48 and the upper surface of the thereof as they pass over the oppositely directed threads 50 have flattened surfaces thereon. This is due to the heat treating and pressure process on this side of the screen. The calendaring process results in a crushing or ellipsing of each of the hairs at the joint (as illustrated by element 52 in FIGS. 5 and 6). The cross-section of FIG. 7 shows that the portion 48 of the thread between crossing threads 52 and 58 remains substantially circular.

Figure 5:
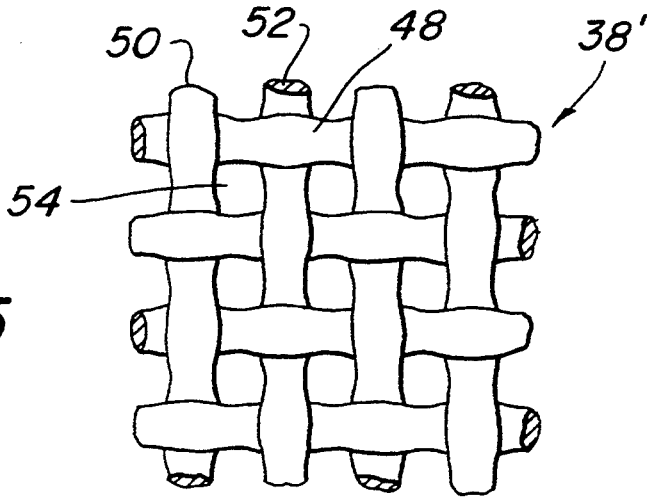
FIG. 5 shows a partial view of the screen material shown in FIG. 4.

Calendaring is generally used to reduce the ink deposits and to increase the edge definition. This is accomplished by thinning the fabric to reduce the height of the ink column between the threads, i.e., in the open areas 54, ready for transfer to the substrate. As shown in FIG. 5, calendaring also results in a slight reduction of the open area 54 between the threads. Calendaring may also be performed on both sides so as to flatten both sides of the surface of the screen.

In using a calendared screen material, failure in high tension operation results at the joints or knuckles due to the localized compression of these joints. The first sign of failure is typically the splintering of the threads at the knuckles or joints. If a screen material could be created that would provide the advantages of this calendaring step, while eliminating this process step in preparing the screen material, such would be a substantial improvement. It would also be an improvement if the failure point is higher in tension while still obtaining the same results of calendaring plus the results of ultra-high tension.

Figure 8:
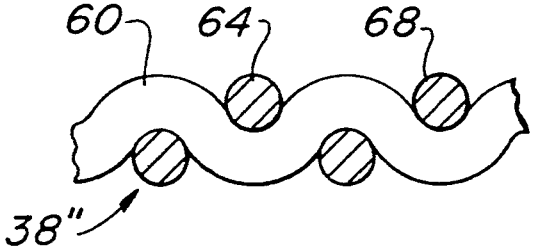
FIG. 8 shows a cross-sectional view of a screen material as contemplated by the present invention.
Figure 9:
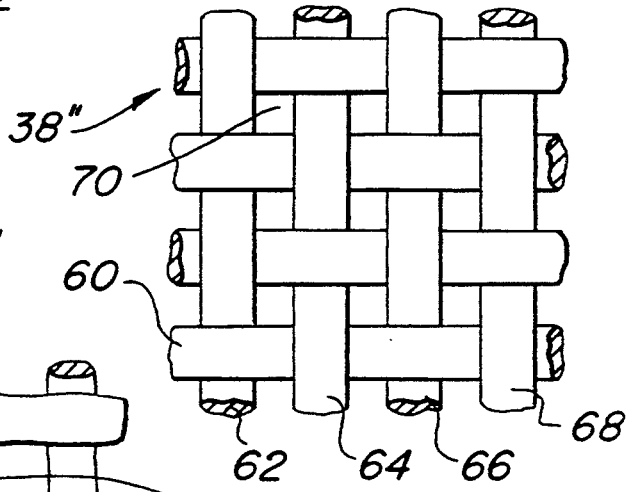
FIG. 9 shows a partial view of the screen material as shown in FIG. 8.

FIGS. 8 and 9 generally show a screen material 38" as contemplated by the present invention. This screen material 38" generally includes threads 60–68 which have an untensioned dimension greater than that contemplated by those known in the prior art, as illustrated in FIGS. 2 and 3. However, the mesh count as woven, i.e., the number of threads per inch, is generally equivalent to that of the mesh count as contemplated by the prior art screen materials. In this type material, as particularly illustrated in FIG. 9, the open area 70 between cross hairs as woven is substantially reduced as compared to that in the known screen material 38.

Figure 10:
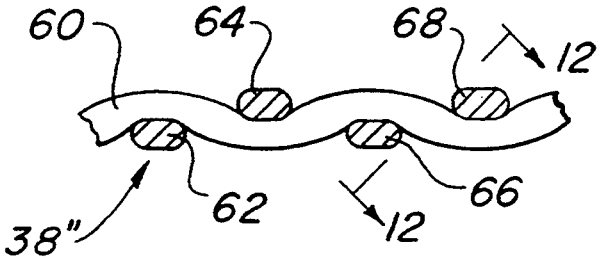
FIG. 10 shows a cross-sectional view of the screen material contemplated by the present invention under an ultra-high tension.
Figure 11:
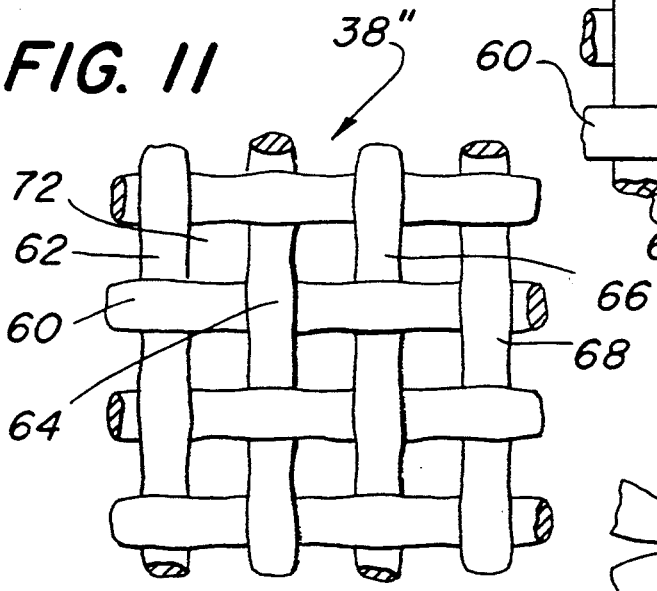
FIG. 11 shows a partial view of the screen material of the present invention under an ultra-high tension as contemplated in FIG. 10.
Figure 12:
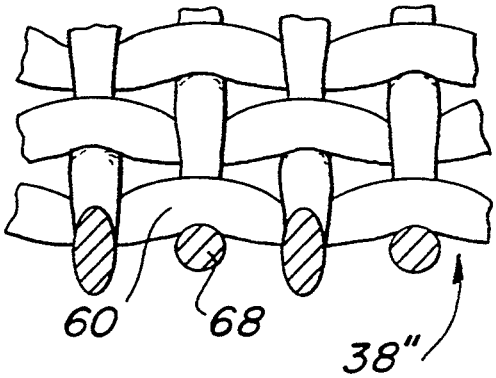
FIG. 12 shows a cross-sectional view of the screen material shown in FIGS. 10 and 11 as taken along line 12—12 in FIG. 10.

FIGS. 10–12 generally show the screen material 38" after tensioning to an ultra-high tension force, such as in the range of 40 to 100 newtons/centimeter. As is illustrated, the tension within the threads 60, 64, 66 and 68 results in a reduction in the cross-sectional area of the thread (compare to FIG. 8 due to its elongation under high tension). Moreover, the threads tend to lose roundness and become somewhat elliptical. As illustrated in FIGS. 11 and 12, the ellipse is substantially reduced in width between the knuckles, i.e., adjacent to the open area 72, whereas at the knuckle the ellipse becomes broader and flatter. This reduction of the thread thickness at the knuckle is due to the force between opposite threads under tension. Moreover, an overall reduction in the thickness of the screen results under this high tension force.

For purposes of representing the variations contemplated by the screen material 38" of the present invention, as compared to that commonly known in the art and the higher tensions being utilized in the resulting screen printing operation, the following chart is provided:

STANDARD FABRIC MAXIMUMS

| MESH (threads per inch) | NOMINAL THREAD DIA. (MICRONS) | % OPEN (AS WOVEN) |
|---|---|---|
| 60 | 145 | 41 |
| 76 | 145 | 31 |
| 86 | 100 | 43 |
| 92 | 100 | 41 |
| 110 | 80 | 42 |
| 125 | 83 | 34 |
| 137 | 73 | 35 |
| 140 | 65 | 40 |
| 156 | 66 | 34 |
| 175 | 55 | 38 |
| 180 | 55 | 36 |
| 195 | 55 | 32 |
| 230 | 54 | 25 |
| 255 | 40 | 36 |

-continued

STANDARD FABRIC MAXIMUMS

| MESH (threads per inch) | NOMINAL THREAD DIA. (MICRONS) | % OPEN (AS WOVEN) |
|---|---|---|
| 280 | 40 | 33 |
| 305 | 40 | 27 |
| 330 | 35 | 31 |
| 355 | 35 | 20 |
| 380 | 35 | 26 |
| 390 | 35 | 24 |
| 420 | 34 | 21 |
| 460 | 33 | 15 |

NEW FABRIC

| MESH | RANGE (MICRONS) | PREFERRED THREAD DIA. | % OPEN (WOVEN) | % OPEN (TENSION) | TENSION (N/cm) |
|---|---|---|---|---|---|
| 60 | 150–160 | 155 | 38 | 45 | 85–120 |
| 70 | 148–160 | 150 | 33 | 41 | 85–120 |
| 76 | 150–160 | 150 | 28 | 38 | 85–120 |
| 88 | 105–120 | 107 | 37 | 45 | 85–110 |
| 92 | 105–120 | 106 | 32 | 40 | 85–110 |
| 110 | 85–100 | 87 | 32 | 44 | 65–85 |
| 115 | 85–100 | 87 | 30 | 42 | 70–90 |
| 125 | 85–100 | 90 | 27 | 35 | 65–85 |
| 138 | 75–100 | 77 | 30 | 42 | 70–85 |
| 140 | 70–100 | 75 | 34 | 40 | 65–85 |
| 140 | 70–100 | 80 | 31 | 38 | 65–85 |
| 156 | 70–90 | 73 | 22 | 32 | 65–85 |
| 168 | 60–80 | 73 | 20 | 28 | 65–85 |
| 175 | 60–80 | 65 | 32 | 40 | 65–80 |
| 180 | 60–80 | 60 | 29 | 48 | 65–80 |
| 195 | 60–80 | 60 | 24 | 32 | 65–80 |
| 195 | 60–80 | 65 | 24 | 26 | 65–80 |
| 205 | 58–75 | 65 | 22 | 32 | 65–80 |
| 230 | 58–70 | 64 | 22 | 28 | 65–85 |
| 255 | 42–65 | 48 | 15 | 26 | 50–60 |
| 255 | 42–65 | 52 | 12 | 24 | 50–70 |
| 280 | 42–55 | 46 | 24 | 32 | 55–65 |
| 280 | 42–55 | 48 | 22 | 31 | 55–65 |
| 305 | 42–50 | 44 | 18 | 28 | 55–65 |
| 305 | 42–50 | 48 | 14 | 27 | 55–60 |
| 330 | 36–48 | 40 | 23 | 32 | 50–60 |
| 330 | 36–48 | 42 | 21 | 29 | 50–65 |
| 355 | 36–48 | 40 | 19 | 28 | 50–65 |
| 355 | 36–48 | 44 | 15 | 25 | 55–70 |
| 362 | 36–48 | 37 | 23 | 30 | 55–70 |
| 362 | 36–48 | 40 | 19 | 30 | 55–70 |
| 380 | 36–48 | 37 | 21 | 26 | 50–65 |
| 380 | 36–48 | 40 | 17 | 25 | 55–70 |
| 390 | 36–48 | 37 | 18 | 26 | 50–70 |
| 390 | 36–48 | 40 | 14 | 24 | 55–70 |
| 403 | 36–42 | 37 | 20 | 25 | 50–60 |
| 403 | 36–42 | 40 | 14 | 23 | 50–60 |
| 420 | 36–42 | 37 | 15 | 25 | 50–65 |
| 420 | 36–42 | 40 | 12 | 23 | 50–60 |
| 440 | 34–42 | 36 | 13 | 20 | 50–60 |
| 460 | 34–42 | 36 | 11 | 18 | 50–60 |
| 460 | 34–42 | 40 | 8 | 16 | 50–60 |

The above chart compares the standard fabric and tensions that are commonly used in the art to the new fabrics and tensions as contemplated by the present invention. Each of the above thread diameters relates to the unwoven filament within the screen. The threads are contemplated to include monofilaments and multifilaments. Additionally, the threads are contemplated to be substantially homogeneous or uniform, that is, excluding coatings such as nickel but not excluding antistatic coatings, plasma treatments and the like which are relatively low in thickness and which do not substantially alter the overall strength of the screen.

Known fabrics have included a maximum thread diameter in each mesh count category. These fabrics have been limited because of the ineffective results on the printed image at standard tensions. However, the present invention, because of the contemplated increase in tension to the fabric results in a substantial advantage to the printing process. As can be seen from this chart, the use of increased tension raises the percent open area to values that approach or are substantially equivalent to the percent open area of the mesh as woven. In lower tension, or standard usage, the open area was restricted to a 1 to 2% increase as compared to the as woven condition. In the materials contemplated by the present invention, the open area percentage as woven is substantially reduced. However, the ability to generally increase the tension results in a much more useful screen material. Moreover, a comparison of FIGS. 5 and 11 illustrate that the resulting mesh pattern of the high tensioned fabric is somewhat the equivalent of a calendaring process. However, a calendaring process is not required in order to prepare the screen material, while the increase in thickness of the thread results in the screen's ability to withstand the ultra-high tensions without fraying at the knuckles at these tensions.

Thus, the heavier threaded material provides additional strength in the higher tensioning of the fabric. Moreover, the percent open area approaches or is substantially the same as that in lower tension materials having a lower nominal thread diameter. However, the advantages in the printing process of high tension are accelerated by the ultra-high tension. These accelerated advantages particularly result in the ability to achieve definition of fine lines as well as the full coverage opacity of the ink in open areas through the use of the same stencil. Other specific advantages are also found and contemplated.

It should be noted that the drawings in the present application are offered for purposes of representing the difference between the prior art screen materials 38 and 38' as utilized with a screen printing frame 10 and as comparing the screen material 38" contemplated by the present invention. Although these drawings are considered representative of the resulting cross hair dimensions, they may not be fully accurate as to their representation thereof. However, the essence of the invention should become apparent to those skilled in the art based upon these drawings and the above description.

The present invention may be embodied in other specific forms without departing from the spirit or essential attributes thereof, and accordingly, reference should be made to the appended claims, rather than to the foregoing specification, as indicating the scope of the invention.

I claim:

1. A method of screen printing, comprising the steps of: providing a printing frame, providing a screen material having threads of substantially uniform composition across the cross section on the frame, tensioning the screen material to a tension in excess of 40 Newtons per centimeter, and printing an image with the screen material as tensioned on the printing frame, wherein the mesh count and unwoven filament thread diameter qualities of the screen material are selected from the group consisting of an approximate mesh count of 60 threads per inch and a nominal thread diameter in excess of 149 microns; an approximate mesh count of 70 threads per inch and a nominal unwoven thread filament diameter in excess of 147 microns; an approximate mesh count of 76 threads per inch and a nominal thread diameter in excess of 149 microns; an approximate mesh count of 88 threads per inch and a nominal thread diameter in excess of 104 microns; an approximate mesh count of 92 threads per inch and a nominal thread diameter in excess of 104 microns; an approximate mesh count of 110 threads per inch and a nominal thread diameter in excess of 84 microns; an approximate mesh count of 115 threads per inch and a nominal thread diameter in excess of 84 microns; an approximate mesh count of 125 threads per inch and a nominal thread diameter in excess of 84 microns; an approximate mesh count of 137 threads per inch and a nominal thread diameter in excess of 74 microns; an approximate mesh count of 140 threads per inch and a nominal thread diameter in excess of 73 microns; an approximate mesh count of 156 threads per inch and a nominal thread diameter in excess of 69 microns; an approximate mesh count of 168 threads per inch and a nominal thread diameter in excess of 65 microns; an approximate mesh count of 175 threads per inch and a nominal thread diameter in excess of 59 microns; an approximate mesh count of 180 threads per inch and a nominal thread diameter in excess of 59 microns; an approximate mesh count of 195 threads per inch and a nominal thread diameter in excess of 59 microns; an approximate mesh count of 205 threads per inch and a nominal thread diameter in excess of 57 microns; an approximate mesh count of 230 threads per inch and a nominal thread diameter in excess of 57 microns; an approximate mesh count of 255 threads per inch and a nominal thread diameter in excess of 41 microns; an approximate mesh count of 280 threads per inch and a nominal thread diameter in excess of 41 microns; an approximate mesh count of 305 threads per inch and a nominal thread diameter in excess of 41 microns; an approximate mesh count of 330 threads per inch and a nominal thread diameter in excess of 35 microns; an approximate mesh count of 355 threads per inch and a nominal thread diameter in excess of 35 microns; an approximate mesh count of 362 threads per inch and a nominal thread diameter in excess of 35 microns; an approximate mesh count of 380 threads per inch and a nominal thread diameter in excess of 35 microns; an approximate mesh count of 390 threads per inch and a nominal thread diameter in excess of 35 microns; an approximate mesh count of 403 threads per inch and a nominal thread diameter in excess of 35 microns; an approximate mesh count of 420 threads per inch and a nominal thread diameter in excess of 35 microns; and an approximate mesh count of 460 threads per inch and a nominal thread diameter in excess of 35 microns.

2. A method of screen printing as claimed in claim 1 wherein the screen tension is in excess of 50 newtons per centimeter.

3. A method of screen printing as claimed in claim 1 wherein the screen material is tensioning step comprises rotating a roller about its longitudinal axis and fixing the roller at the desired rotative position so as to maintain tension in the screen.

4. A method of screen printing according to claim 3 wherein the roller is rotated to provide a tension in the screen in excess of 50 newtons per centimeter.

5. A screen material for use in conjunction with a printing frame for screen printing, the frame having the ability of varying the tension in the screen, such as by at least one roller mounted at its ends for rotation about its longitudinal axis, and maintaining the tension at a constant level during printing, the screen material comprising: a woven fabric having threads of substantially uniform composition across the cross section and an approximate mesh count and nominal thread diameter combination selected from the group consisting of 60 threads per inch and 155 microns; 70 threads per inch and 150 microns; 76 threads per inch and 150 microns; 88 threads per inch and 107 microns; 92 threads per inch and 106 microns; 110 threads per inch and 87 microns; 125 threads per inch and 90 microns; 138 threads per inch and 77 microns; 140 threads per inch and 80 microns; 156 threads per inch and 73 microns; 168 threads per inch and 73 microns; 175 threads per inch and 65 microns; 180 threads per inch and 60 microns; 195 threads per inch and 60 microns; 195 threads per inch and 65 microns; 205 threads per inch and 65 microns; 230 threads per inch and 64 microns; 255 threads per inch and 44 microns; 255 threads per inch and 48 microns; 280 threads per inch and 45 microns; 280 threads per inch and 48 microns; 305 threads per inch and 44 microns; 305 threads per inch and 48 microns; 330 threads per inch and 40 microns; 330 threads per inch and 42 microns; 355 threads per inch and 40 microns; 355 threads per inch and 44 microns; 362 threads per inch and 37 microns; 362 threads per inch and 40 microns; 380 threads per inch and 37 microns; 380 threads per inch and 40 microns; 390 threads per inch and 37 microns; 390 threads per inch and 40 microns; 403 threads per inch and 37 microns; 403 threads per inch and 40 microns; 420 threads per inch and 37 microns; 420 threads per inch and 40 microns; 440 threads per inch and 36 microns; 460 threads per inch and 36 microns; and 460 threads per inch and 40 microns.

6. An apparatus for screen printing of the type having a series of rollers and roller mounting means, the series of rollers attached at opposite ends to the roller mounting means so as to form a frame, a screen material having a stencil of an image to be printed thereon, means for securing the screen material to the rollers, the rollers mounted on the mounting means for rotation about their longitudinal axis and for tensioning the screen material, and means for securing the rollers in a predetermined rotative position and screen tension, the improvement comprising: a screen material having threads of substantially uniform composition across the cross section selected from the group consisting of 60 threads per inch and 155 microns; 70 threads per inch and 150 microns; 76 threads per inch and 150 microns; 88 threads per inch and 107 microns; 92 threads per inch and 106 microns; 110 threads per inch and 87 microns; 125 threads per inch and 90 microns; 138 threads per inch and 77 microns; 140 threads per inch and 80 microns; 156 threads per inch and 73 microns; 168 threads per inch and 73 microns; 175 threads per inch and 65 microns; 180 threads per inch and 60 microns; 195 threads per inch and 60 microns; 195 threads per inch and 65 microns; 205 threads per inch and 65 microns; 230 threads per inch and 64 microns; 255 threads per inch and 44 microns; 255 threads per inch and 48 microns; 280 threads per inch and 45 microns; 280 threads per inch and 48 microns; 305 threads per inch and 44 microns; 305 threads per inch and 48 microns; 330 threads per inch and 40 microns; 330 threads per inch and 42 microns; 355 threads per inch and 40 microns; 355 threads per inch and 44 microns; 362 threads per inch and 37 microns; 362 threads per inch and 40 microns; 380 threads per inch and 37 microns; 380 threads per inch and 40 microns; 390 threads per inch and 37 microns; 390 threads per inch and 40 microns; 403 threads per inch and 37 microns; 403 threads per inch and 40 microns; 420 threads per inch and 37 microns; 420 threads per inch and 40 microns; 440 threads per inch and 36 microns; 460 threads per inch and 36 microns; and 460 threads per inch and 40 microns.

7. A screen material for use in conjunction with a printing frame for screen printing, the printing frame having a series of rollers and roller mounting means, the series of rollers attached at opposite ends to the roller mounting means and forming a frame, the screen material having a stench of the image to be printed thereon, the screen material secured to the rollers by a securing means such that, when the rollers are rotated about their longitudinal axis, the screen is tensioned substantially equidistant along its length, and the roller mounting means securing the rollers in a predetermined rotated position and screen tension, the screen material comprising: a woven fabric having threads of substantially uniform composition across the cross section selected from the group consisting of an approximate mesh count of 60 threads per inch and a nominal diameter in the range of 150 to 160 microns; an approximate mesh count of 70 threads per inch and a nominal thread diameter in the range of 148 to 160 microns; an approximate mesh count of 76 threads per inch and a nominal thread diameter in the range of 150 to 160 microns; an approximate mesh count of 88 threads per inch and a nominal thread diameter in the range of 105 to 120 microns; an approximate mesh count of 92 threads per inch and a nominal thread diameter in the range of 105 to 120 microns; an approximate mesh count of 110 threads per inch and a nominal thread diameter in the range of 85 to 100 microns; an approximate mesh count of 115 threads per inch and a nominal thread diameter in the range of 85 to 100 microns; an approximate mesh count of 125 threads per inch and a nominal thread diameter in the range of 85 to 100 microns; an approximate mesh count of 138 threads per inch and a nominal thread diameter in the range of 75 to 100 microns; an approximate mesh count of 140 threads per inch and a nominal thread diameter in the range of 70 to 80 microns; an approximate mesh count of 156 threads per inch and a nominal thread diameter in the range of 70 to 90 microns; an approximate mesh count of 168 threads per inch and a nominal thread diameter in the range of 60 to 80 microns; an approximate mesh count of 175 threads per inch and a nominal thread diameter in the range of 60 to 80 microns; an approximate mesh count of 180 threads per inch and a nominal thread diameter in the range of 60 to 80 microns; an approximate mesh count of 195 threads per inch and a nominal thread diameter in the range of 60 to 80 microns; an approximate mesh count of 205 threads per inch and a nominal thread diameter in the range of 58 to 75 microns; an approximate mesh count of 230 threads per inch and a nominal thread diameter in the range of 58 to 70 microns; an approximate mesh count of 255 threads per inch and a nominal thread diameter in the range of 42 to 65 microns; an approximate mesh count of 280 threads per inch and a nominal thread diameter in the range of 42 to 55 microns; an approximate mesh count of 305 threads per inch and a nominal thread diameter in the range of 42 to 50 microns; an approximate mesh count of 330 threads per inch and a nominal thread diameter in the range of 36 to 48 microns; an approximate mesh count of 355 threads per inch and a nominal thread diameter in the range of 36 to 48 microns; an approximate mesh count of 362 threads per inch and a nominal thread diameter in the range of 36 to 48 microns; an approximate mesh count of 380 threads per inch and a nominal thread diameter in the range of 36 to 48 microns; an approximate mesh count of 390 threads per inch and a nominal thread diameter in the range of 36 to 48 microns; an approximate mesh count of 403 threads per inch and a nominal thread diameter in the range of 36 to 42 microns; an approximate mesh count of 420 threads per inch and a nominal thread diameter in the range of 36 to 42 microns; an approximate mesh count of 440 threads per inch and a nominal thread diameter in the range of 34 to 42 microns; and an approximate mesh count of 460 threads per inch and a nominal thread diameter in the range of 34 to 42 microns.

8. An apparatus as claimed in claim 6, wherein the threads are made of polyester.

9. A screen material for use in conjunction with a printing frame for screen printing, the frame having the ability of varying the tension in the screen, such as by at least one roller mounted at its ends for rotation about its longitudinal axis, and maintaining the tension at a constant level during printing, the screen material comprising: a woven fabric having threads of substantially uniform composition across the cross section selected from the group consisting of an approximate mesh count of 60 threads per inch and a nominal diameter in the range of 150 to 160 microns; an approximate mesh count of 70 threads per inch and a nominal thread diameter in the range of 148 to 160 microns; an approximate mesh count of 76 threads per inch and a nominal thread diameter in the range of 150 to 160 microns; an approximate mesh count of 88 threads per inch and a nominal thread diameter in the range of 105 to 120 microns; an approximate mesh count of 92 threads per inch and a nominal thread diameter in the range of 105 to 120 microns; an approximate mesh count of 110 threads per inch and a nominal thread diameter in the range of 85 to 100 microns; an approximate mesh count of 115 threads per inch and a nominal thread diameter in the range of 85 to 100 microns; an approximate mesh count of 125 threads per inch and a nominal thread diameter in the range of 85 to 100 microns; an approximate mesh count of 138 threads per inch and a nominal thread diameter in the range of 75 to 100 microns; an approximate mesh count of 140 threads per inch and a nominal thread diameter in the range of 70 to 80 microns; an approximate mesh count of 156 threads per inch and a nominal thread diameter in the range of 70 to 90 microns; an approximate mesh count of 168 threads per inch and a nominal thread diameter in the range of 60 to 80 microns; an approximate mesh count of 175 threads per inch and a nominal thread diameter in the range of 60 to 80 microns; an approximate mesh count of 180 threads per inch and a nominal thread diameter in the range of 60 to 80 microns; an approximate mesh count of 195 threads per inch and a nominal thread diameter in the range of 60 to 80 microns; an approximate mesh count of 205 threads per inch and a nominal thread diameter in the range of 58 to 75 microns; an approximate mesh count of 230 threads per inch and a nominal thread diameter in the range of 58 to 70 microns; an approximate mesh count of 255 threads per inch and a nominal thread diameter in the range of 42 to 65 microns; an approximate mesh count of 280 threads per inch and a nominal thread diameter in the range of 42 to 55 microns; an approximate mesh count of 305 threads per inch and a nominal thread diameter in the range of 42 to 50 microns; an approximate mesh count of 330 threads per inch and a nominal thread diameter in the range of 36 to 48 microns; an approximate mesh count of 355 threads per inch and a nominal thread diameter in the range of 36 to 48 microns; an approximate mesh count of 362 threads per inch and a nominal thread diameter in the range of 36 to 48 microns; an approximate mesh count of 380 threads per inch and a nominal thread diameter in the range of 36 to 48 microns; an approximate mesh count of 390 threads per inch and a nominal thread diameter in the range of 36 to 48 microns; and an approximate mesh count of 403 threads per inch and a nominal thread diameter in the range of 36 to 42 microns.

* * * * *